US011059290B2

(12) United States Patent
Govyadinov et al.

(10) Patent No.: US 11,059,290 B2
(45) Date of Patent: Jul. 13, 2021

(54) FLUID EJECTION DEVICE

(71) Applicant: HEWLETT-PACKARD DEVELOPMENT COMPANY, L.P., Fort Collins, CO (US)

(72) Inventors: Alexander Govyadinov, Corvallis, OR (US); Tsuyoshi Yamashita, Corvallis, OR (US); Nicholas McGuinness, San Diego, CA (US); David P Markel, Corvallis, OR (US); Erik D Tornianen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 191 days.

(21) Appl. No.: 16/095,575

(22) PCT Filed: Jul. 29, 2016

(86) PCT No.: PCT/US2016/044831
§ 371 (c)(1),
(2) Date: Oct. 22, 2018

(87) PCT Pub. No.: WO2018/022103
PCT Pub. Date: Feb. 1, 2018

(65) Prior Publication Data

US 2020/0353748 A1 Nov. 12, 2020

(51) Int. Cl.
*B41J 2/14* (2006.01)
*B41J 2/21* (2006.01)

(52) U.S. Cl.
CPC ..... *B41J 2/14* (2013.01); *B41J 2/211* (2013.01); *B41J 2002/14467* (2013.01); *B41J 2202/12* (2013.01)

(58) Field of Classification Search
CPC ..... B41J 2/14; B41J 2/211; B41J 2/18; B41J 2002/14467; B41J 2202/12
See application file for complete search history.

(56) References Cited

U.S. PATENT DOCUMENTS 5,889,538 A * 3/1999 Kishimoto ..... B41J 2/211 347/20
8,641,175 B2 2/2014 Panchawagh et al.
8,777,346 B2 7/2014 Satou et al.
8,814,293 B2 8/2014 Strunk et al.
9,156,262 B2 2/2015 Taff et al.
(Continued)

FOREIGN PATENT DOCUMENTS

CN 102218909 10/2011
CN 103003577 3/2013
(Continued)

*Primary Examiner* — Scott A Richmond
(74) *Attorney, Agent, or Firm* — Dicke Billig & Czaja PLLC

(57) ABSTRACT

A fluid ejection device includes a fluid slot, three laterally adjacent fluid ejection chambers each having a drop ejecting element therein, a fluid circulation path communicated with each of the three laterally adjacent fluid ejection chambers, and a fluid circulating element within the fluid circulation path, with at least two laterally adjacent fluid ejection chambers of the three laterally adjacent fluid ejection chambers to substantially simultaneously eject drops of fluid therefrom such that the drops of fluid are to coalesce during flight.

18 Claims, 8 Drawing Sheets

(56) References Cited

U.S. PATENT DOCUMENTS

| | | | | |
|---|---|---|---|---|
| 8,991,986 | B2 | 3/2015 | Sowinski et al. | |
| 2011/0234669 | A1* | 9/2011 | Benjamin | B41J 2/0458 347/10 |
| 2013/0155152 | A1* | 6/2013 | Govyadinov | F04B 19/24 347/54 |
| 2013/0278688 | A1 | 10/2013 | Bibl | |
| 2016/0039208 | A1* | 2/2016 | Van De Vrie | B29D 11/00009 347/85 |

FOREIGN PATENT DOCUMENTS

| | | |
|---|---|---|
| CN | 103153627 | 6/2013 |
| CN | 103442896 | 12/2013 |
| CN | 103502013 | 1/2014 |
| CN | 104302483 | 1/2015 |
| WO | WO-2016068909 A1 | 5/2016 |

* cited by examiner

FLUID EJECTION DEVICE

BACKGROUND

Fluid ejection devices, such as printheads in inkjet printing systems, may use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead and the print medium move relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
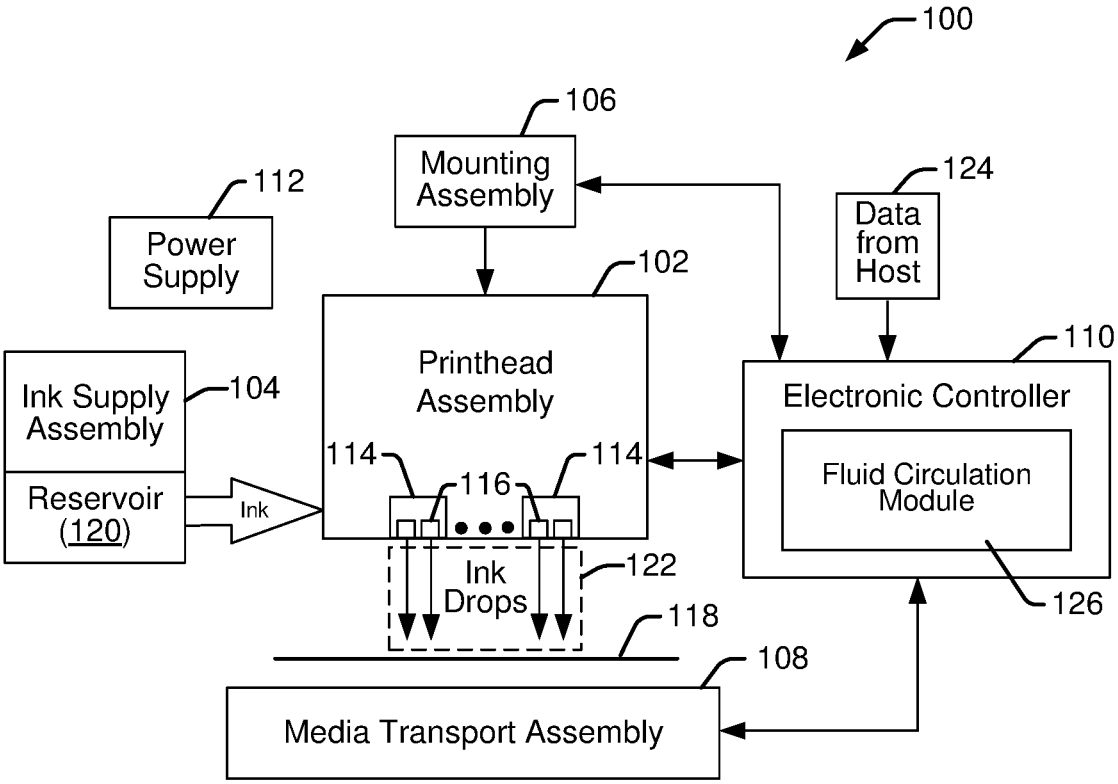
FIG. 1 is a block diagram illustrating one example of an inkjet printing system including an example of a fluid ejection device.

FIG. 1 illustrates one example of an inkjet printing system as an example of a fluid ejection device with fluid circulation, as disclosed herein. Inkjet printing system 100 includes a printhead assembly 102, an ink supply assembly 104, a mounting assembly 106, a media transport assembly 108, an electronic controller 110, and at least one power supply 112 that provides power to the various electrical components of inkjet printing system 100. Printhead assembly 102 includes at least one fluid ejection assembly 114 (printhead 114) that ejects drops of ink through a plurality of orifices or nozzles 116 toward a print medium 118 so as to print on print media 118.

Print media 118 can be any type of suitable sheet or roll material, such as paper, card stock, transparencies, Mylar, and the like, and may include rigid or semi-rigid material, such as cardboard or other panels. Nozzles 116 are typically arranged in one or more columns or arrays such that properly sequenced ejection of ink from nozzles 116 causes characters, symbols, and/or other graphics or images to be printed on print media 118 as printhead assembly 102 and print media 118 are moved relative to each other.

Ink supply assembly 104 supplies fluid ink to printhead assembly 102 and, in one example, includes a reservoir 120 for storing ink such that ink flows from reservoir 120 to printhead assembly 102. Ink supply assembly 104 and printhead assembly 102 can form a one-way ink delivery system or a recirculating ink delivery system. In a one-way ink delivery system, substantially all of the ink supplied to printhead assembly 102 is consumed during printing. In a recirculating ink delivery system, only a portion of the ink supplied to printhead assembly 102 is consumed during printing. Ink not consumed during printing is returned to ink supply assembly 104.

In one example, printhead assembly 102 and ink supply assembly 104 are housed together in an inkjet cartridge or pen. In another example, ink supply assembly 104 is separate from printhead assembly 102 and supplies ink to printhead assembly 102 through an interface connection, such as a supply tube. In either example, reservoir 120 of ink supply assembly 104 may be removed, replaced, and/or refilled. Where printhead assembly 102 and ink supply assembly 104 are housed together in an inkjet cartridge, reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions printhead assembly 102 relative to media transport assembly 108, and media transport assembly 108 positions print media 118 relative to printhead assembly 102. Thus, a print zone 122 is defined adjacent to nozzles 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108. Thus, media transport assembly 108 positions print media 118 relative to printhead assembly 102.

Electronic controller 110 typically includes a processor, firmware, software, one or more memory components including volatile and non-volatile memory components, and other printer electronics for communicating with and controlling printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one example, electronic controller 110 controls printhead assembly 102 for ejection of ink drops from nozzles 116. Thus, electronic controller 110 defines a pattern of ejected ink drops which form characters, symbols, and/or other graphics or images on print media 118. The pattern of ejected ink drops is determined by the print job commands and/or command parameters.

Printhead assembly 102 includes one or more printheads 114. In one example, printhead assembly 102 is a wide-array or multi-head printhead assembly. In one implementation of a wide-array assembly, printhead assembly 102 includes a carrier that carries a plurality of printheads 114, provides electrical communication between printheads 114 and electronic controller 110, and provides fluidic communication between printheads 114 and ink supply assembly 104.

In one example, inkjet printing system 100 is a drop-on-demand thermal inkjet printing system wherein printhead 114 is a thermal inkjet (TIJ) printhead. The thermal inkjet printhead implements a thermal resistor ejection element in an ink chamber to vaporize ink and create bubbles that force ink or other fluid drops out of nozzles 116. In another example, inkjet printing system 100 is a drop-on-demand piezoelectric inkjet printing system wherein printhead 114 is a piezoelectric inkjet (PIJ) printhead that implements a piezoelectric material actuator as an ejection element to generate pressure pulses that force ink drops out of nozzles 116.

In one example, electronic controller 110 includes a flow circulation module 126 stored in a memory of controller 110. Flow circulation module 126 executes on electronic controller 110 (i.e., a processor of controller 110) to control the operation of one or more fluid actuators integrated as pump elements within printhead assembly 102 to control circulation of fluid within printhead assembly 102.

Figure 2:
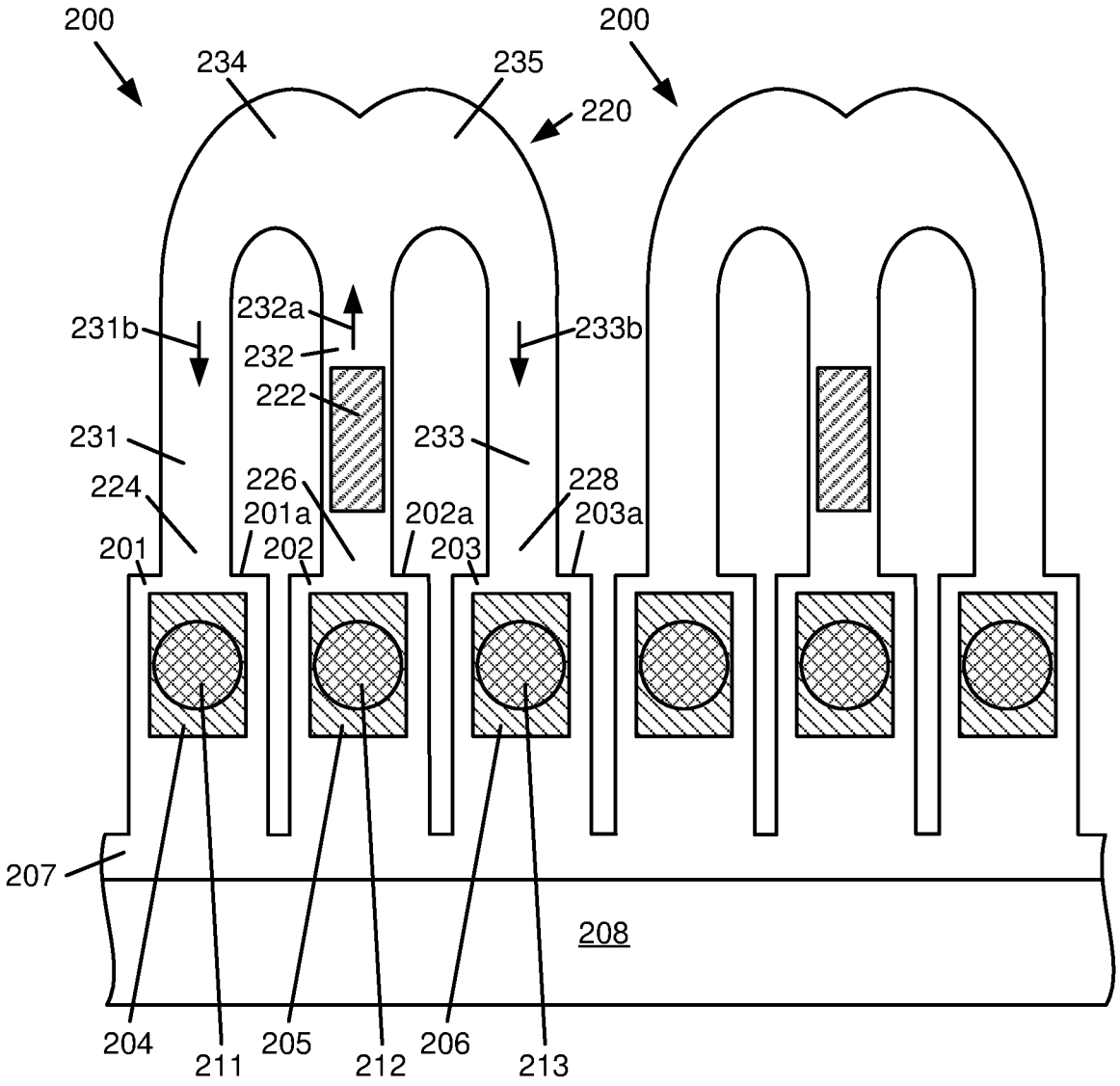
FIG. 2 is a schematic plan view illustrating an example of a portion of a fluid ejection device.

FIG. 2 is a schematic plan view illustrating an example of a portion of a fluid ejection device 200. Fluid ejection device 200 includes a fluid ejection chamber 201 and a corresponding drop ejecting element 204 formed in, provided within, or communicated with fluid ejection chamber 201, a fluid ejection chamber 202 and a corresponding drop ejecting element 205 formed in, provided within, or communicated with fluid ejection chamber 202, and a fluid ejection chamber 203 and a corresponding drop ejecting element 206 formed in, provided within, or communicated with fluid ejection chamber 203.

In one example, fluid ejection chambers 201, 202 and 203 and drop ejecting elements 204, 205 and 206 are formed on a substrate 207 which has a fluid (or ink) feed slot 208 formed therein such that fluid feed slot 208 provides a supply of fluid (or ink) to fluid ejection chambers 201, 202 and 203 and drop ejecting elements 204, 205 and 206. Fluid feed slot 208 includes, for example, a hole, passage, opening, convex geometry or other fluidic architecture formed in or through substrate 207 by which or through which fluid is supplied to fluid ejection chambers 201, 202 and 203. Fluid feed slot 208 may include one (i.e., a single) or more than one (e.g., a series of) such hole, passage, opening, convex geometry or other fluidic architecture that communicates fluid with one (i.e., a single) or more than one fluid ejection chamber, and may be of circular, non-circular, or other shape. Substrate 207 may be formed, for example, of silicon, glass, or a stable polymer.

In one example, fluid ejection chambers 201, 202 and 203 are formed in or defined by a barrier layer (not shown) provided on substrate 207, such that fluid ejection chambers 201, 202 and 203 each provide a "well" in the barrier layer. The barrier layer may be formed, for example, of a photo-imageable epoxy resin, such as SU8. In one example, a nozzle or orifice layer (not shown) is formed or extended over the barrier layer such that nozzle openings or orifices 211, 212 and 213 formed in the orifice layer communicate with respective fluid ejection chambers 201, 202 and 203.

In one example, as illustrated in FIG. 2, nozzle openings or orifices 211, 212 and 213 are of the same size and shape. As such, nozzle openings or orifices 211, 212 and 213 enable the ejection of drops of the same size (weight). Accordingly, drop ejecting elements 204, 205 and 206 may be operated separately or individually at different moments of time to produce drops of the same size (weight), or operated simultaneously (substantially simultaneously) to produce a combined drop of a combined size (weight), as described below. Nozzle openings or orifices 211, 212 and 213 may be of a circular, non-circular, or other shape. Although illustrated in FIG. 2 as being of the same size, nozzle openings or orifices 211, 212 and 213 may be of different sizes (for example, different diameters, effective diameters, or maximum dimensions), as described below. Although illustrated as being of the same shape, nozzle openings or orifices 211, 212 and 213 may be of different shapes (for example, one circular, one non-circular). In addition, although illustrated as being of the same shape and same size, drop ejecting elements 204, 205 and 206 and corresponding fluid ejection chambers 201, 202 and 203 may be of different shapes, and may be of different sizes.

Drop ejecting elements 204, 205 and 206 can be any device capable of ejecting fluid drops through corresponding nozzle openings or orifices 211, 212 and 213. Examples of drop ejecting elements 204, 205 and 206 include thermal resistors or piezoelectric actuators. A thermal resistor, as an example of a drop ejecting element, may be formed on a surface of a substrate (substrate 207), and may include a thin-film stack including an oxide layer, a metal layer, and a passivation layer such that, when activated, heat from the thermal resistor vaporizes fluid in corresponding fluid ejection chamber 201, 202 or 203, thereby causing a bubble that ejects a drop of fluid through corresponding nozzle opening or orifice 211, 212 or 213. A piezoelectric actuator, as an example of a drop ejecting element, generally includes a piezoelectric material provided on a moveable membrane communicated with corresponding fluid ejection chamber 201, 202 or 203 such that, when activated, the piezoelectric material causes deflection of the membrane relative to corresponding fluid ejection chamber 201, 202 or 203, thereby generating a pressure pulse that ejects a drop of fluid through corresponding nozzle opening or orifice 211, 212 or 213.

As illustrated in the example of FIG. 2, fluid ejection device 200 includes a fluid circulation path or channel 220 and a fluid circulating element 222 formed in, provided within, or communicated with fluid circulation channel 220. Fluid circulation channel 220 is open to and communicates with fluid ejection chamber 201, is open to and communicates with fluid ejection chamber 202, and is open to and communicates with fluid ejection chamber 203. In one example, an end 224 of fluid circulation channel 220 communicates with fluid ejection chamber 201 at an end 201*a* of fluid ejection chamber 201, an end 226 of fluid circulation channel 220 communicates with fluid ejection chamber 202 at an end 202*a* of fluid ejection chamber 202, and end 228 of fluid circulation channel 220 communicates with fluid ejection chamber 203 at an end 203*a* of fluid ejection chamber 203.

In one example, fluid circulating element 222 is provided in, provided along, or communicated with fluid circulation channel 220 between fluid ejection chamber 201 and fluid ejection chamber 202 and between fluid ejection chamber 202 and fluid ejection chamber 203. In other examples, a position of fluid circulating element 222 may vary along fluid circulation channel 220.

Fluid circulating element 222 forms or represents an actuator to pump or circulate (or recirculate) fluid through fluid circulation channel 220. As such, fluid from fluid feed slot 208 circulates (or recirculates) through fluid circulation channel 220 and fluid ejection chambers 201, 202 and 203 based on flow induced by fluid circulating element 222. In one example, circulating (or recirculating) fluid through fluid ejection chambers 201, 202 and 203 helps to reduce ink blockage and/or clogging in fluid ejection device 200.

In the example illustrated in FIG. 2, drop ejecting elements 204, 205 and 206 and fluid circulating element 222 are each thermal resistors. Each of the thermal resistors may include, for example, a single resistor, a split resistor, a comb resistor, or multiple resistors. A variety of other devices, however, can also be used to implement drop ejecting elements 204, 205 and 206 and fluid circulating element 222 including, for example, a piezoelectric actuator, an electrostatic (MEMS) membrane, a mechanical/impact driven membrane, a voice coil, a magneto-strictive drive, and so on.

In one example, fluid circulation channel 220 includes a path or channel portion 231 communicated with fluid ejection chamber 201, a path or channel portion 232 communicated with fluid ejection chamber 202, and a path or channel portion 233 communicated with fluid ejection chamber 203. As such, in one example, fluid in fluid circulation channel 220 circulates (or recirculates) between fluid ejection chamber 201 and fluid ejection chamber 202 through channel portion 231 and channel portion 232, and circulates (or recirculates) between fluid ejection chamber 202 and fluid ejection chamber 203 through channel portion 232 and channel portion 233.

In one example, fluid circulation channel 220 forms a fluid circulation (or recirculation) loop between fluid feed slot 208, fluid ejection chamber 201, fluid ejection chamber 202, and fluid ejection chamber 203. For example, fluid from fluid feed slot 208 circulates (or recirculates) through fluid ejection chamber 202, through fluid circulation channel 220, and through fluid ejection chamber 201 and fluid ejection chamber 203 back to fluid feed slot 208. More specifically, fluid from fluid feed slot 208 circulates (or recirculates) through fluid ejection chamber 202, through channel portion 232, through channel portions 231 and 233, and through fluid ejection chambers 201 and 203 back to fluid feed slot 208.

As illustrated in the example of FIG. 2, fluid circulating element 222 is formed in, provided within, or communicated with channel portion 232 of fluid circulation channel 220, and forms an asymmetry to fluid circulation channel 220 whereby a fluid flow distance between fluid circulating element 222 and fluid ejection chamber 202 is less than a fluid flow distance between fluid circulating element 222 and fluid ejection chambers 201 and 203. As such, in one example, channel portion 232 directs fluid in a first direction, as indicated by arrow 232*a*, channel portion 231 directs fluid in a second direction opposite the first direction, as indicated by arrow 231*b*, and channel portion 233 directs fluid in the second direction opposite the first direction, as indicated by arrow 233*b*. More specifically, in one example, fluid circulation channel 220 directs fluid in a first direction (arrow 232*a*) between fluid ejection chamber 201 and fluid ejection chamber 202 and between fluid ejection chamber 202 and fluid ejection chamber 203, and directs fluid in a second direction (arrow 231*b* and arrow 233*b*) opposite the first direction between fluid ejection chamber 201 and fluid ejection chamber 202 and between fluid ejection chamber 202 and fluid ejection chamber 203. Thus, in one example, fluid circulating element 222 creates an average or net fluid flow in fluid circulation channel 220 between fluid ejection chamber 201 and fluid ejection chamber 202 (viz., from fluid ejection chamber 202 to fluid ejection chamber 201) and between fluid ejection chamber 202 and fluid ejection chamber 203 (viz., from fluid ejection chamber 202 to fluid ejection chamber 203).

In one example, to provide fluid flow in the first direction indicated by arrow 232*a* and the second, opposite direction indicated by arrow 231*b* and arrow 233*b*, fluid circulation channel 220 includes a channel loop 234 between channel portion 231 and channel portion 232, and a channel loop 235 between channel portion 232 and channel portion 233. As such, in one example, fluid circulation channel 220 directs fluid in the first direction (arrow 232*a*) between fluid ejection chamber 202 and channel loops 234 and 235, and in the second direction (arrow 231*b* and arrow 233*b*) between channel loop 234 and fluid ejection chamber 201 and between channel loop 235 and fluid ejection chamber 203. In one example, channel loop 234 includes a U-shaped portion of fluid circulation channel 220 such that a length (or portion) of channel portion 231 and a length (or portion) of channel portion 232 are spaced from and oriented substantially parallel with each other, and channel loop 235 includes a U-shaped portion of fluid circulation channel 220 such that a length (or portion) of channel portion 232 and a length (or portion) of channel portion 233 are spaced from and oriented substantially parallel with each other.

In one example, a width of channel portion 231, a width of channel portion 232, and a width of channel portion 233 are substantially equal. In addition, a length of channel portion 231, a length of channel portion 232, and a length of channel portion 233 are substantially equal. Furthermore, as illustrated in the example of FIG. 2, a width of channel portion 231 is less than a width of fluid ejection chamber 201, a width of channel portion 232 is less than a width of fluid ejection chamber 202, and a width of channel portion 233 is less than a width of fluid ejection chamber 203. In other examples, channel portions 231, 232 and 233 (including sections, segments or regions thereof) may be of different widths, and may be of different lengths.

As illustrated in the example of FIG. 2, an array or series of fluid ejection devices 200 is provided along a length of fluid feed slot 208. More specifically, one fluid ejection device 200 including fluid circulation path 220 with corresponding fluid circulating element 222, fluid ejection chamber 201 with corresponding drop ejecting element 204, fluid ejection chamber 202 with corresponding drop ejecting element 205, and fluid ejection chamber 203 with corresponding drop ejecting element 206 is laterally adjacent another fluid ejection device 200 including fluid circulation path 220 with corresponding fluid circulating element 222, fluid ejection chamber 201 with corresponding drop ejecting element 204, fluid ejection chamber 202 with corresponding drop ejecting element 205, and fluid ejection chamber 203 with corresponding drop ejecting element 206 along one side of fluid feed slot 208. In one example, fluid ejection devices 200 are arranged on opposite sides of fluid feed slot 208 such that corresponding nozzle openings or orifices 211, 212 and 213 of fluid ejection devices 200 are arranged in parallel (substantially parallel) columns (or arrays).

As illustrated in the example of FIG. 2, fluid ejection chamber 201 is laterally adjacent fluid ejection chamber 202, and fluid ejection chamber 202 is laterally adjacent fluid ejection chamber 203. More specifically, fluid ejection chamber 201 is positioned to one side of fluid ejection chamber 202 along fluid feed slot 208, and fluid ejection chamber 202 is positioned to one side of fluid ejection chamber 203 along fluid feed slot 208 such that fluid ejection chamber 202 is positioned between fluid ejection chamber 201 and fluid ejection chamber 203 along fluid feed slot 208. As such, fluid ejection chambers 201, 202 and 203 are laterally adjacent to each other. Accordingly, drop ejecting elements 204, 205 and 206 may be operated separately or individually at different moments of time to produce drops of the same size (weight), or operated substantially simultaneously to produce a combined drop of a combined size (weight).

Figure 3C:
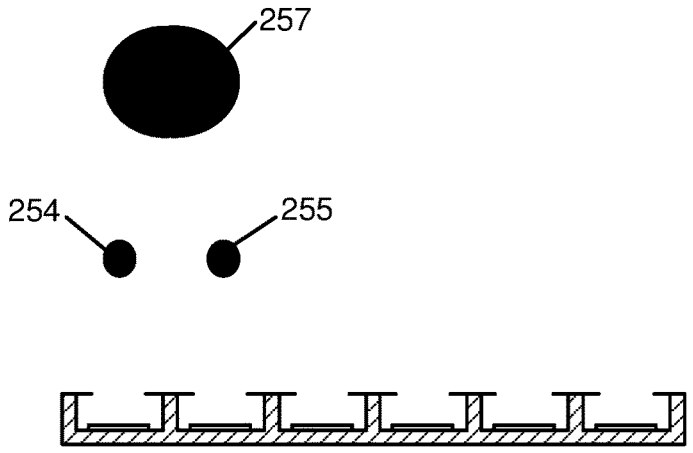
FIGS. 3A, 3B, 3C are schematic cross-sectional views illustrating an example of operation of the fluid ejection device of FIG. 2.
Figure 3B:
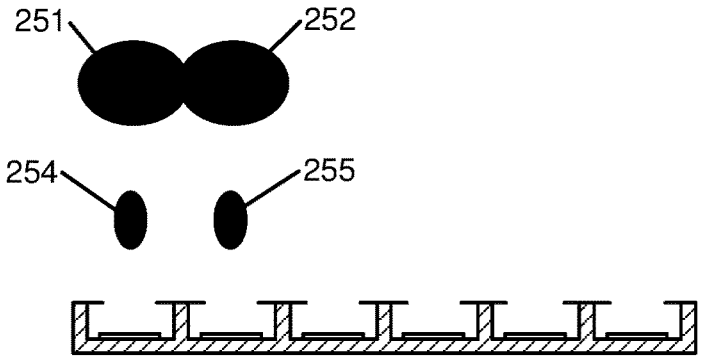
Figure 3A:
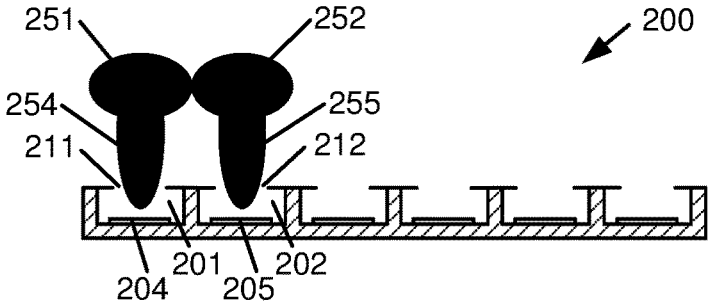

More specifically, in one example, as illustrated in FIGS. 3A, 3B, 3C, laterally adjacent drop ejecting elements 204 and 205 of fluid ejection device 200 are operated substantially simultaneously to produce a combined drop of a combined size (weight). For example, as illustrated in FIG. 3A, substantially simultaneous ejection of fluid from fluid ejection chambers 201 and 202 (through respective nozzles 211 and 212) results in individual drops 251 and 252 (with respective tails 254 and 255) being formed. Subsequently, as illustrated in FIG. 3B, individual drops 251 and 252 begin to merge (and tails 254 and 255 break off). Thereafter, as illustrated in FIG. 3C, a single, merged drop 257 is formed (with tails 254 and 255 dissipating).

Figure 4C:
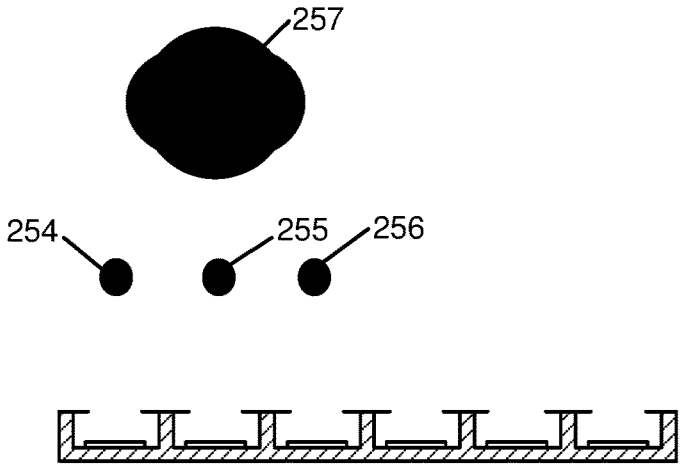
FIGS. 4A, 4B, 4C are schematic cross-sectional views illustrating an example of operation of the fluid ejection device of FIG. 2.
Figure 4B:
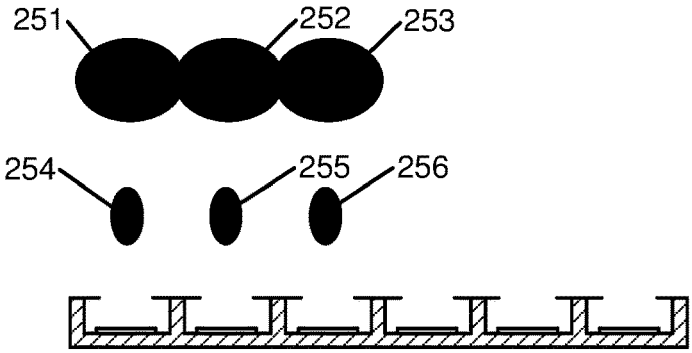
Figure 4A:
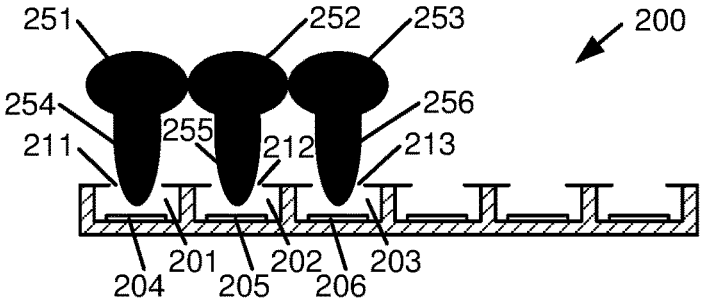

In another example, as illustrated in FIGS. 4A, 4B, 4C, laterally adjacent drop ejecting elements 204, 205 and 206 of fluid ejection device 200 are operated substantially simultaneously to produce a combined drop of a combined size (weight). For example, as illustrated in FIG. 4A, substantially simultaneous ejection of fluid from fluid ejection chambers 201, 202 and 203 (through respective nozzles 211, 212 and 213) results in individual drops 251, 252 and 253 (with respective tails 254, 255 and 256) being formed.

Subsequently, as illustrated in FIG. 4B, individual drops 251, 252 and 253 begin to merge (and tails 254, 255 and 256 break off). Thereafter, as illustrated in FIG. 4C, a single, merged drop 257 is formed (with tails 254, 255 and 256 dissipating).

Figure 5:
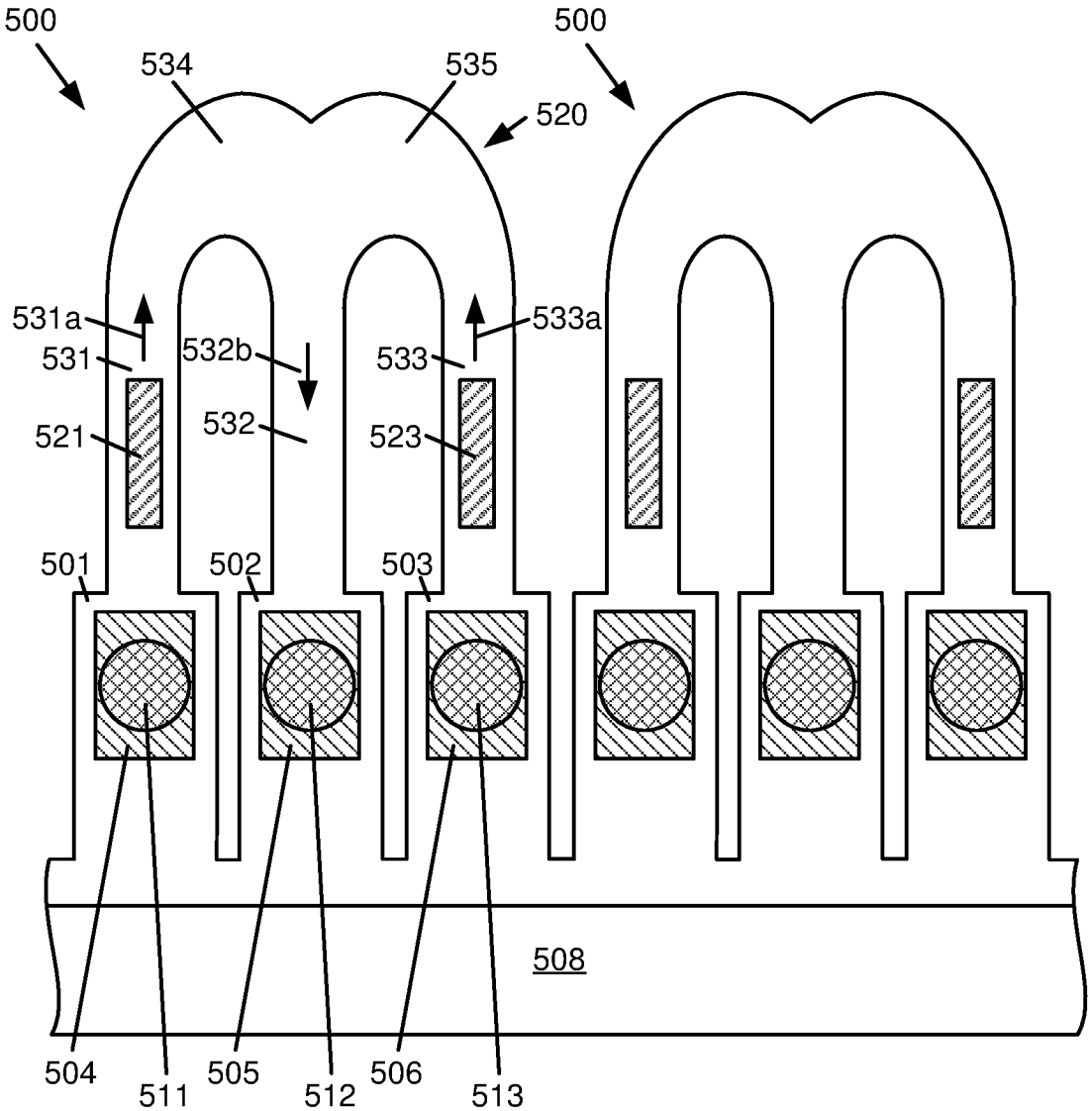
FIG. 5 is a schematic plan view illustrating an example of a portion of a fluid ejection device.

FIG. 5 is a schematic plan view illustrating an example of a portion of a fluid ejection device 500. Similar to fluid ejection device 200, fluid ejection device 500 includes a fluid ejection chamber 501 with a corresponding drop ejecting element 504, a fluid ejection chamber 502 with a corresponding drop ejecting element 505, and a fluid ejection chamber 503 with a corresponding drop ejecting element 506, such that nozzle openings or orifices 511, 512 and 513 communicate with respective fluid ejection chambers 501, 502 and 503. In one example, nozzle openings or orifices 511, 512 and 513 are each of the same shape and size. In addition, drop ejecting elements 504, 505 and 506 are each of the same shape and size. Although illustrated as being of the same shape and same size, nozzle openings or orifices 511, 512 and 513, and drop ejecting elements 504, 505 and 506, may be of different shapes, and may be of different sizes.

Similar to fluid ejection device 200, fluid ejection device 500 includes a fluid circulation path or channel 520 including a path or channel portion 531 communicated with fluid ejection chamber 501, a path or channel portion 532 communicated with fluid ejection chamber 502, and a path or channel portion 533 communicated with fluid ejection chamber 503. As such, in one example, fluid in fluid circulation channel 520 circulates (or recirculates) between fluid ejection chamber 501 and fluid ejection chamber 502 through channel portion 531 and channel portion 532, and circulates (or recirculates) between fluid ejection chamber 502 and fluid ejection chamber 503 through channel portion 532 and channel portion 533.

As illustrated in the example of FIG. 5, fluid ejection device 500 includes a fluid circulating element 521 and a fluid circulating element 523 provided in, provided along, or communicated with fluid circulation channel 520. In one example, fluid circulating element 521 is provided in, provided along, or communicated with fluid circulation channel 520 between fluid ejection chamber 501 and fluid ejection chamber 502, and fluid circulating element 523 is provided in, provided along, or communicated with fluid circulation channel 520 between fluid ejection chamber 502 and fluid ejection chamber 503. In other examples, a position of fluid circulating elements 521 and 523 may vary along fluid circulation channel 520. Similar to fluid circulating element 222, fluid circulating elements 521 and 523 form or represent actuators to pump or circulate (or recirculate) fluid through fluid circulation channel 520. As such, fluid from fluid feed slot 508 circulates (or recirculates) through fluid circulation channel 520 and fluid ejection chambers 501, 502 and 503 based on flow induced by fluid circulating elements 521 and 523.

Similar to fluid circulation channel 220 of fluid ejection device 200, fluid circulation channel 520 of fluid ejection device 500 forms a fluid circulation (or recirculation) loop between fluid feed slot 508, fluid ejection chamber 501, fluid ejection chamber 502, and fluid ejection chamber 503. For example, fluid from fluid feed slot 508 circulates (or recirculates) through fluid ejection chamber 501 and fluid ejection chamber 503, through fluid circulation channel 520, and through fluid ejection chamber 502 back to fluid feed slot 508. More specifically, fluid from fluid feed slot 508 circulates (or recirculates) through fluid ejection chambers 501 and 503, through channel portions 531 and 533, through channel portion 532, and through fluid ejection chamber 502 back to fluid feed slot 508.

As illustrated in the example of FIG. 5, fluid circulating element 521 is formed in, provided within, or communicated with channel portion 531 of fluid circulation channel 520, and fluid circulating element 523 is formed in, provided within, or communicated with channel portion 533 of fluid circulation channel 520. As such, in one example, fluid circulating element 521 creates an average or net fluid flow in fluid circulation channel 520 between fluid ejection chamber 501 and fluid ejection chamber 502 (viz., from fluid ejection chamber 501 to fluid ejection chamber 502), and fluid circulating element 523 creates an average or net fluid flow in fluid circulation channel 520 between fluid ejection chamber 502 and fluid ejection chamber 503 (viz., from fluid ejection chamber 503 to fluid ejection chamber 502). More specifically, in one example, channel portion 531 and channel portion 533 each direct fluid in a first direction, as indicated by arrow 531*a* and arrow 533*a*, and channel portion 532 directs fluid in a second direction opposite the first direction, as indicated by arrow 532*b*. Furthermore, in one example, and similar to fluid circulation channel 220 of fluid ejection device 200, fluid circulation channel 520 includes a channel loop 534 between channel portion 531 and channel portion 532, and includes a channel loop 535 between channel portion 532 and channel portion 533, wherein channel loop 534 and channel loop 535 each include a U-shaped portion of fluid circulation channel 520.

Similar to fluid ejection device 200, drop ejecting elements 504, 505 and 506 of fluid ejection device 500 may be operated separately or individually at different moments of time to produce drops of the same size (weight), or operated substantially simultaneously to produce a combined drop of a combined size (weight). Similar to that described above, substantially simultaneous ejection of fluid from laterally adjacent fluid ejection chambers 501, 502 or 503 (through respective nozzles 511, 512 or 513) results in individual drops being formed such that the individual drops merge into a single drop.

Figure 6:
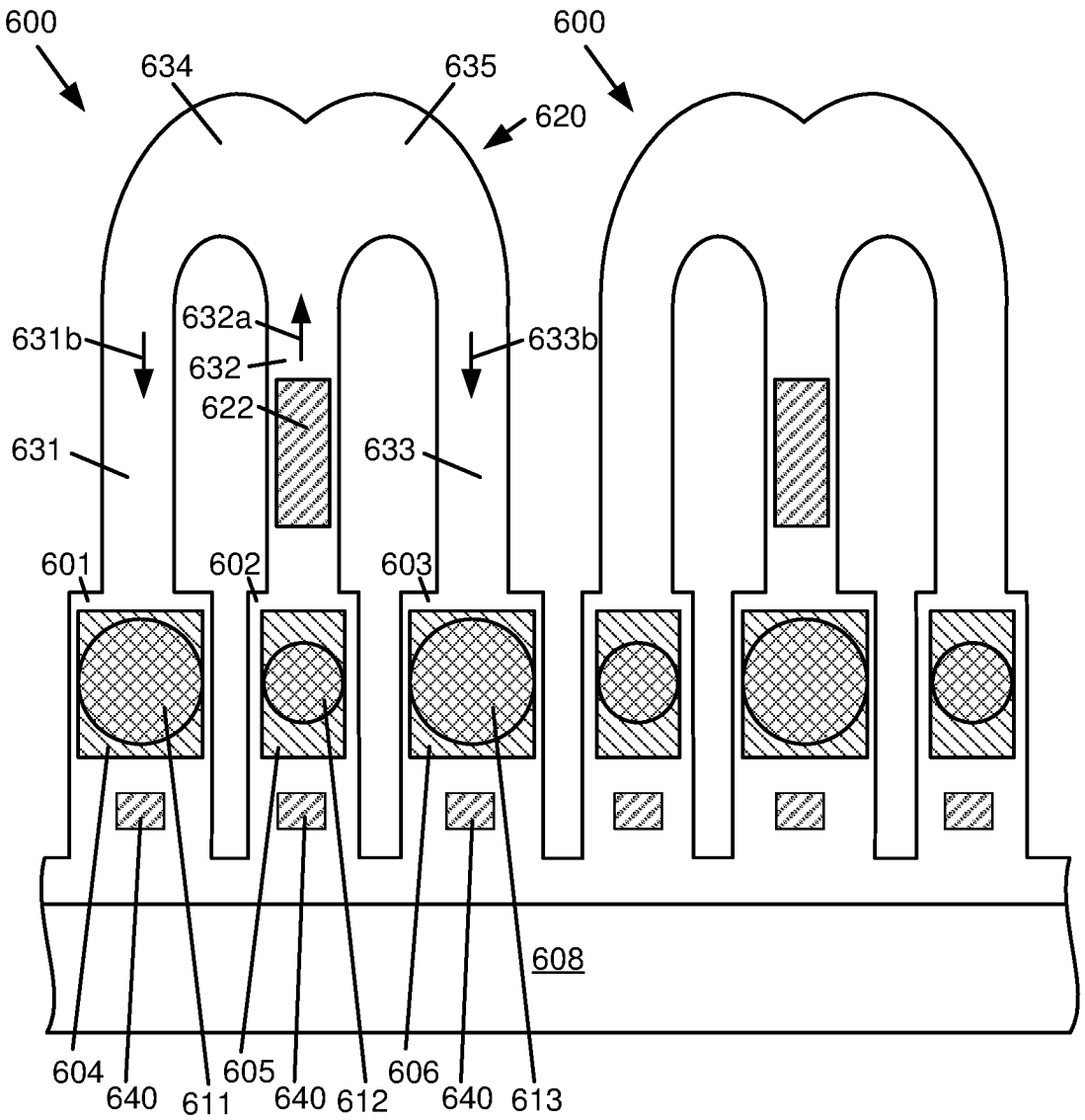
FIG. 6 is a schematic plan view illustrating an example of a portion of a fluid ejection device.

FIG. 6 is a schematic plan view illustrating an example of a portion of a fluid ejection device 600. Similar to fluid ejection device 200, fluid ejection device 600 includes a fluid ejection chamber 601 with a corresponding drop ejecting element 604, a fluid ejection chamber 602 with a corresponding drop ejecting element 605, and a fluid ejection chamber 603 with a corresponding drop ejecting element 606, such that nozzle openings or orifices 611, 612 and 613 communicate with respective fluid ejection chambers 601, 602 and 603.

Similar to fluid ejection device 200, fluid ejection device 600 includes a fluid circulation path or channel 620 with a corresponding fluid circulating element 622. In one example, fluid circulating element 622 is provided in, provided along, or communicated with fluid circulation channel 620 between fluid ejection chamber 601 and fluid ejection chamber 602 and between fluid ejection chamber 602 and fluid ejection chamber 603. In other examples, a position of fluid circulating element 622 may vary along fluid circulation channel 620. Similar to fluid circulating element 222, fluid circulating element 622 forms or represents an actuator to pump or circulate (or recirculate) fluid through fluid circulation channel 620.

In one example, and as illustrated in FIG. 6, fluid circulation channel 620 includes a path or channel portion 631 communicated with fluid ejection chamber 601, a path or channel portion 632 communicated with fluid ejection chamber 602, and a path or channel portion 633 communicated with fluid ejection chamber 603. As such, in one example, fluid in fluid circulation channel 620 circulates (or recirculates) between fluid ejection chamber 601 and fluid ejection chamber 602 through channel portion 631 and channel portion 632, and circulates (or recirculates) between fluid ejection chamber 602 and fluid ejection chamber 603 through channel portion 632 and channel portion 633.

Similar to fluid circulation channel 220 of fluid ejection device 200, fluid circulation channel 620 of fluid ejection device 600 forms a fluid circulation (or recirculation) loop between fluid feed slot 608, fluid ejection chamber 601, fluid ejection chamber 602, and fluid ejection chamber 603. In addition, and similar to fluid circulating element 222 of fluid ejection device 200, fluid circulating element 622 is formed in, provided within, or communicated with channel portion 632 of fluid circulation channel 620. As such, in one example, fluid circulating element 622 creates an average or net fluid flow in fluid circulation channel 620 between fluid ejection chamber 601 and fluid ejection chamber 602 (viz., from fluid ejection chamber 602 to fluid ejection chamber 601) and between fluid ejection chamber 602 and fluid ejection chamber 603 (viz., from fluid ejection chamber 602 to fluid ejection chamber 603). More specifically, in one example, channel portion 632 directs fluid in a first direction, as indicated by arrow 632*a*, channel portion 631 directs fluid in a second direction opposite the first direction, as indicated by arrow 631*b*, and channel portion 633 directs fluid in the second direction opposite the first direction, as indicated by arrow 633*b*. Furthermore, in one example, and similar to fluid circulation channel 220 of fluid ejection device 200, fluid circulation channel 620 includes a channel loop 634 between channel portion 631 and channel portion 632, and includes a channel loop 635 between channel portion 632 and channel portion 633, wherein channel loop 634 and channel loop 635 each include a U-shaped portion of fluid circulation channel 620.

In one example, fluid ejection device 600 includes an object tolerant architecture 640 between fluid feed slot 608 and fluid ejection chambers 601, 602 and 603. Object tolerant architecture 640 includes, for example, a pillar, column, post or other structure (or structures), and forms an "island" which allows fluid to flow past while preventing objects, such as air bubbles or particles (e.g., dust, fibers), from flowing into fluid ejection chambers 601, 602 or 603 from fluid feed slot 608. Such objects, if allowed to enter fluid ejection chambers 601, 602 or 603, may affect the performance of fluid ejection device 600, including, for example, the performance of drop ejecting elements 604, 605 or 606. Other examples of a fluid ejection device, as disclosed herein, may include an object tolerant architecture.

In the example illustrated in FIG. 6, nozzle openings or orifices 611, 612 and 613 (with corresponding drop ejecting elements 604, 605 and 606) are of different sizes. In addition, fluid ejection chambers 601, 602 and 603 are of different sizes. More specifically, in one example, nozzle openings or orifices 611 and 613 (with corresponding drop ejecting elements 604 and 606 and fluid ejection chambers 601 and 603) are larger than nozzle opening or orifice 612 (with corresponding drop ejecting element 605 and fluid ejection chamber 602). As such, nozzle openings or orifices 611 and 613 form "high" drop-weight nozzles and nozzle opening or orifice 612 forms a "low" drop-weight nozzle.

Similar to fluid ejection device 200, drop ejecting elements 604, 605 and 606 of fluid ejection device 600 may be operated separately or individually at different moments of time to produce individual drops of a respective size (weight), or operated substantially simultaneously to produce a combined drop of a combined size (weight). Similar to that described above, substantially simultaneous ejection of fluid from laterally adjacent fluid ejection chambers 601, 602 or 603 (through respective nozzles 611, 612 or 613) results in individual drops being formed such that the individual drops merge into a single drop. Thus, providing nozzle openings or orifices 611, 612 and 613 of different sizes enables ejection of different combinations of drop sizes (weights) from fluid ejection chambers 601, 602 and 603.

For example, substantially simultaneous ejection of fluid from laterally adjacent fluid ejection chambers 601 and 602 (through respective nozzles 611 and 612) results in a "high" drop-weight drop (1H) and a "low" drop-weight drop (1L) being formed such that the drops merge into a single drop of a combined weight (1H+1L). In addition, substantially simultaneous ejection of fluid from laterally adjacent fluid ejection chambers 601, 602 and 603 (through respective nozzles 611, 612 and 613) results in two "high" drop-weight drops (2H) and one "low" drop-weight drop (1L) being formed such that the drops merge into a single drop of a combined weight (2H+1L). In other examples, substantially simultaneous ejection of fluid from other laterally adjacent fluid ejection chambers (with corresponding drop ejecting elements) through respective nozzle openings or orifices of other sizes results in other combinations of drop sizes (weights) that form merged drops of other combined weights.

Figure 7:
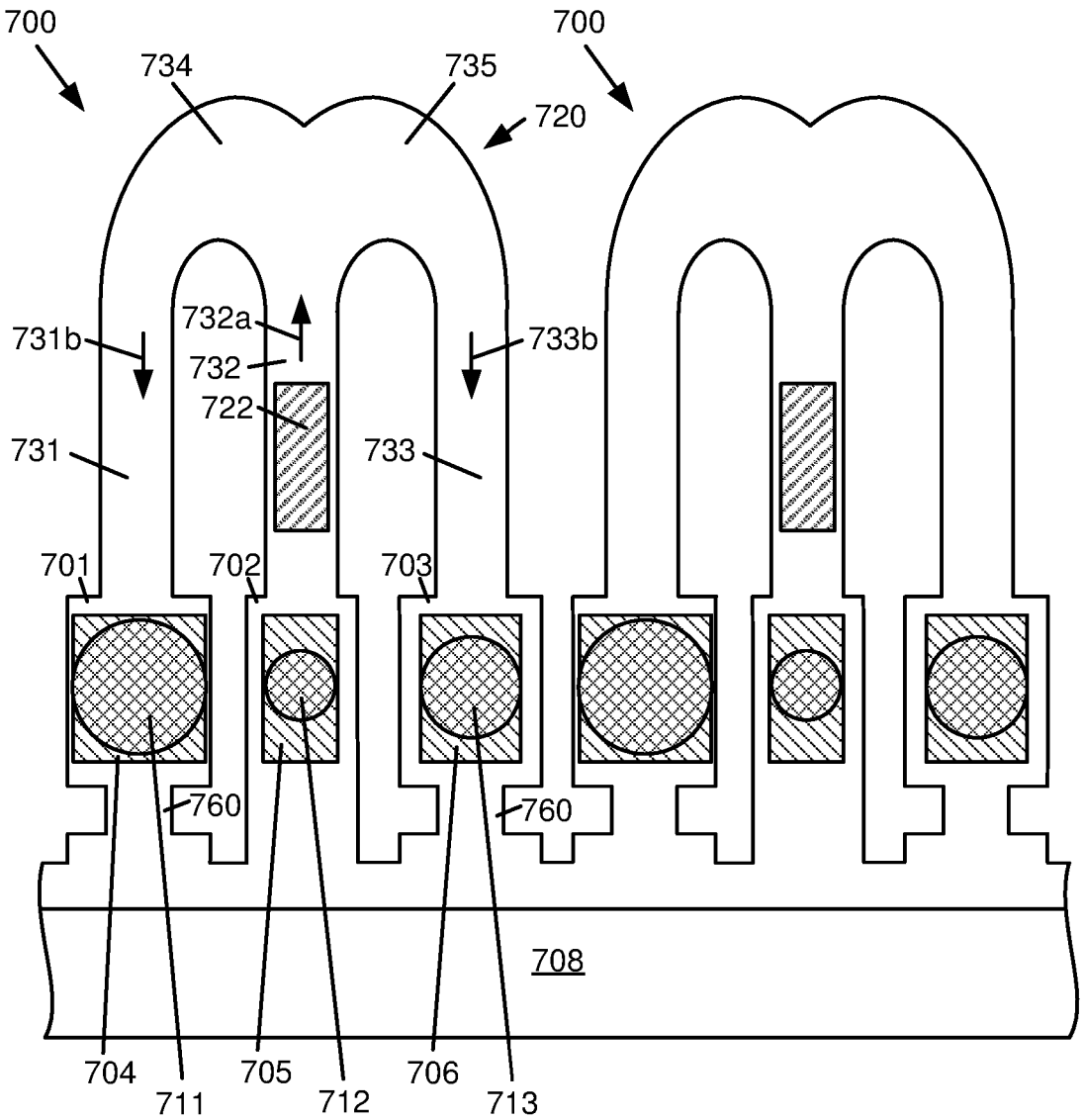
FIG. 7 is a schematic plan view illustrating an example of a portion of a fluid ejection device.

FIG. 7 is a schematic plan view illustrating an example of a portion of a fluid ejection device 700. Similar to fluid ejection device 200, fluid ejection device 700 includes a fluid ejection chamber 701 with a corresponding drop ejecting element 704, a fluid ejection chamber 702 with a corresponding drop ejecting element 705, and a fluid ejection chamber 703 with a corresponding drop ejecting element 706, such that nozzle openings or orifices 711, 712 and 713 communicate with respective fluid ejection chambers 701, 702 and 703.

Similar to fluid ejection device 200, fluid ejection device 700 includes a fluid circulation path or channel 720 with a corresponding fluid circulating element 722. In one example, fluid circulating element 722 is provided in, provided along, or communicated with fluid circulation channel 720 between fluid ejection chamber 701 and fluid ejection chamber 702 and between fluid ejection chamber 702 and fluid ejection chamber 703. In other examples, a position of fluid circulating element 722 may vary along fluid circulation channel 720. Similar to fluid circulating element 222, fluid circulating element 722 forms or represents an actuator to pump or circulate (or recirculate) fluid through fluid circulation channel 720.

In one example, and as illustrated in FIG. 7, fluid circulation channel 720 includes a path or channel portion 731 communicated with fluid ejection chamber 701, a path or channel portion 732 communicated with fluid ejection chamber 702, and a path or channel portion 733 communicated with fluid ejection chamber 703. As such, in one example, fluid in fluid circulation channel 720 circulates (or recirculates) between fluid ejection chamber 701 and fluid ejection chamber 702 through channel portion 731 and channel portion 732, and circulates (or recirculates) between fluid ejection chamber 702 and fluid ejection chamber 703 through channel portion 732 and channel portion 733.

Similar to fluid circulation channel 220 of fluid ejection device 200, fluid circulation channel 720 of fluid ejection device 700 forms a fluid circulation (or recirculation) loop between fluid feed slot 708, fluid ejection chamber 701, fluid ejection chamber 702, and fluid ejection chamber 703. In addition, and similar to fluid circulating element 222 of fluid ejection device 200, fluid circulating element 722 is formed in, provided within, or communicated with channel portion 732 of fluid circulation channel 720. As such, in one example, fluid circulating element 722 creates an average or net fluid flow in fluid circulation channel 720 between fluid ejection chamber 701 and fluid ejection chamber 702 (viz., from fluid ejection chamber 702 to fluid ejection chamber 701) and between fluid ejection chamber 702 and fluid ejection chamber 703 (viz., from fluid ejection chamber 702 to fluid ejection chamber 703). More specifically, in one example, channel portion 732 directs fluid in a first direction, as indicated by arrow 732*a*, channel portion 731 directs fluid in a second direction opposite the first direction, as indicated by arrow 731*b*, and channel portion 733 directs fluid in the second direction opposite the first direction, as indicated by arrow 733*b*. Furthermore, in one example, and similar to fluid circulation channel 220 of fluid ejection device 200, fluid circulation channel 720 includes a channel loop 734 between channel portion 731 and channel portion 732, and includes a channel loop 735 between channel portion 732 and channel portion 733, wherein channel loop 734 and channel loop 735 each include a U-shaped portion of fluid circulation channel 720.

In one example, fluid ejection device 700 includes a "pinch" or narrowed portion 760 formed between fluid feed slot 708 and fluid ejection chambers 701 and 703. Providing narrowed portion 760 helps to "de-couple" fluid ejection chambers 701, 702 and 703 and mitigate cross-talk between fluid ejection chambers 701, 702 and 703. Other examples of a fluid ejection device, as disclosed herein, may include a "pinch" or narrowed portion.

In the example illustrated in FIG. 7, nozzle openings or orifices 711, 712 and 713 (with corresponding drop ejecting elements 704, 705 and 706) are of different sizes. In addition, fluid ejection chambers 701, 702 and 703 are of different sizes. More specifically, in one example, nozzle opening or orifice 711 (with corresponding drop ejecting element 704 and fluid ejection chamber 701) is larger than nozzle opening or orifice 713 (with corresponding drop ejecting element 706 and fluid ejection chamber 703), and nozzle opening or orifice 713 (with corresponding drop ejecting element 706 and fluid ejection chamber 703), is larger than nozzle opening or orifice 712 (with corresponding drop ejecting element 705 and fluid ejection chamber 702). As such, nozzle opening or orifice 711 forms a "high" drop-weight nozzle, nozzle opening or orifice 713 forms a "medium" drop-weight nozzle, and nozzle opening or orifice 712 forms a "low" drop-weight nozzle.

Similar to fluid ejection device 200, drop ejecting elements 704, 705 and 706 of fluid ejection device 700 may be operated separately or individually at different moments of time to produce individual drops of a respective size (weight), or operated substantially simultaneously to produce a combined drop of a combined size (weight). Similar to that described above, substantially simultaneous ejection of fluid from laterally adjacent fluid ejection chambers 701, 702 or 703 (through respective nozzles 711, 712 or 713) results in individual drops being formed such that the individual drops merge into a single drop. Thus, providing nozzle openings or orifices 711, 712 and 713 of different sizes enables ejection of different combinations of drop sizes (weights) from fluid ejection chambers 701, 702 and 703.

For example, substantially simultaneous ejection of fluid from laterally adjacent fluid ejection chambers 701 and 702 (through respective nozzles 711 and 712) results in a "high" drop-weight drop (1H) and a "low" drop-weight drop (1L) being formed such that the drops merge into a single drop of a combined weight (1H+1L). In addition, substantially simultaneous ejection of fluid from laterally adjacent fluid ejection chambers 702 and 703 (through respective nozzles 712 and 713) results in a "low" drop-weight drop (1L) and a "medium" drop-weight drop (1M) being formed such that the drops merge into a single drop of a combined weight (1L+1M). Furthermore, substantially simultaneous ejection of fluid from laterally adjacent fluid ejection chambers 701, 702 and 703 (through respective nozzles 711, 712 and 713) results in a "high" drop weight drop (1H), a "low" drop weight drop (1L), and a "medium" drop-weight drop (1M) being formed such that the drops merge into a single drop of a combined weight (1H+1L+1M). In other examples, substantially simultaneous ejection of fluid from other laterally adjacent fluid ejection chambers (with corresponding drop ejecting elements) through respective nozzle openings or orifices of other sizes results in other combinations of drop sizes (weights) that form merged drops of other combined weights.

Figure 8:
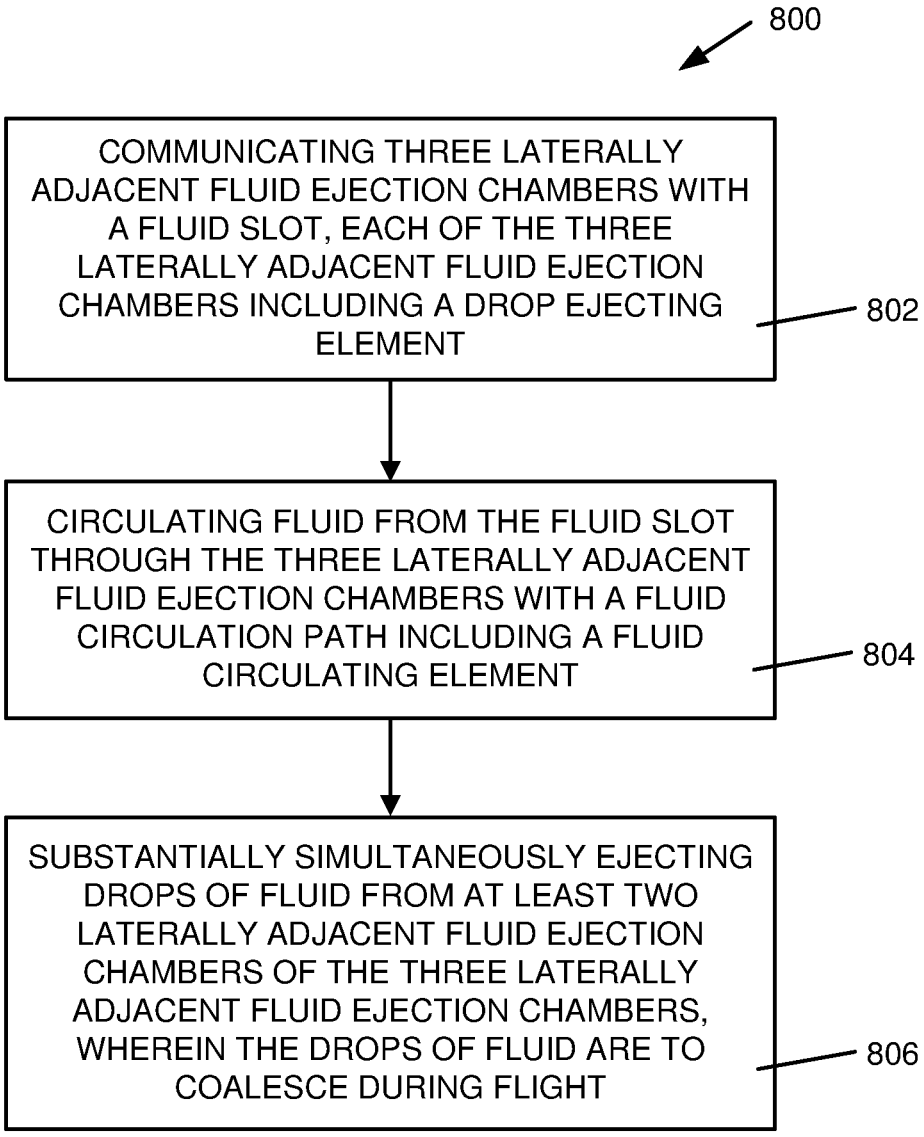
FIG. 8 is a flow diagram illustrating an example of a method of operating a fluid ejection device.

FIG. 8 is a flow diagram illustrating an example of a method 800 of operating a fluid ejection device, such as fluid ejection device 200, 500, 600, 700 as illustrated in the respective examples of FIGS. 2, 5, 6, 7, and FIGS. 3A, 3B, 3C and 4A, 4B, 4C.

At 802, method 800 includes communicating three laterally adjacent fluid ejection chambers with a fluid slot, with each of the three laterally adjacent fluid ejection chambers including a drop ejecting element, such as fluid ejection chambers 201/202/203, 501/502/503, 601/602/603, 701/702/703, including respective drop ejecting elements 204/205/206, 504/505/506, 604/605/606, 704/705/706, communicating with respective fluid feed slots 208, 508, 608, 708.

At 804, method 800 includes circulating fluid from the fluid slot through the three laterally adjacent fluid ejection chambers through a fluid circulation path including a fluid circulating element, such as fluid from respective fluid feed slots 208, 508, 608, 708 circulating though fluid ejection chambers 201/202/203, 501/502/503, 601/602/603, 701/

702/703 through respective fluid circulation paths or channels 220, 520, 620, 720 including respective fluid circulating elements 222, 522, 622, 722.

At 806, method 800 includes substantially simultaneously ejecting drops of fluid from at least two laterally adjacent fluid ejection chambers of the three laterally adjacent fluid ejection chambers, wherein the drops of fluid are to coalesce during flight, such as individual drops 251/252, 251/252/253 ejecting from respective fluid ejection chambers 201/202, 201/202/203 and combining as respective merged drops 257.

Although illustrated and described as separate and/or sequential steps, the method of forming the fluid ejection device may include a different order or sequence of steps, and may combine one or more steps or perform one or more steps concurrently, partially or wholly.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. A fluid ejection device, comprising:

a fluid slot;

three laterally adjacent fluid ejection chambers each having a drop ejecting element therein;

a fluid circulation path communicated with each of the three laterally adjacent fluid ejection chambers; and a fluid circulating element within a portion of the fluid circulation path extended between at least two laterally adjacent fluid ejection chambers of the three laterally adjacent fluid ejection chambers, at least two laterally adjacent fluid ejection chambers of the three laterally adjacent fluid ejection chambers to substantially simultaneously eject drops of fluid therefrom, wherein the drops of fluid are to coalesce during flight.

2. The fluid ejection device of claim 1, wherein the fluid circulation path includes a first portion communicated with a first of the three laterally adjacent fluid ejection chambers, a second portion communicated with a second of the three laterally adjacent fluid ejection chambers, a third portion communicated with a third of the three laterally adjacent fluid ejection chambers, a first channel loop between the first portion and the second portion, and a second channel loop between the second portion and the third portion, wherein the portion of the fluid circulation path having the fluid circulating element therewithin comprises one of the first portion, the second portion, and the third portion.

3. The fluid ejection device of claim 2, wherein the fluid circulating element is within the second portion of the fluid circulation path.

4. The fluid ejection device of claim 2, wherein the fluid circulating element comprises a first fluid circulating element within the first portion of the fluid circulation path and a second fluid circulating element within the third portion of the fluid circulation path.

5. The fluid ejection device of claim 2, wherein the first portion of the fluid circulation path is to direct fluid in a first direction, the second portion of the fluid circulation path is to direct fluid in a second direction opposite the first direction, and the third portion of the fluid circulation path is to direct fluid in the first direction.

6. The fluid ejection device of claim 1, wherein the three laterally adjacent fluid ejection chambers are to substantially simultaneously eject drops of fluid therefrom, wherein the drops of fluid are to coalesce during flight.

7. The fluid ejection device of claim 1, wherein the three laterally adjacent fluid ejection chambers each are to eject drops of fluid of substantially the same size.

8. The fluid ejection device of claim 1, wherein the three laterally adjacent fluid ejection chambers are to eject drops of fluid of different sizes.

9. The fluid ejection device of claim 1, wherein two of the three laterally adjacent fluid ejection chambers are to eject drops of fluid of substantially the same size.

10. The fluid ejection device of claim 1, wherein a fluid flow distance between the fluid circulating element and a first of the three laterally adjacent fluid ejection chambers is less than a fluid flow distance between the fluid circulating element and each of a second of the three laterally adjacent fluid ejection chambers and a third of the three laterally adjacent fluid ejection chambers.

11. A fluid ejection device, comprising:

a fluid slot;

a plurality of fluid ejection chambers each communicated with the fluid slot and having a drop ejecting element;

a fluid circulation path communicated with three of the fluid ejection chambers laterally adjacent to each other; and a fluid circulating element within a portion of the fluid circulation path extended between at least two of the fluid ejection chambers laterally adjacent to each other of the three of the fluid ejection chambers, wherein at least two of the fluid ejection chambers laterally adjacent to each other of the three of the fluid ejection chambers are to substantially simultaneously eject drops of fluid, wherein the drops of fluid are to coalesce in flight.

12. The fluid ejection device of claim 11, wherein the fluid circulating element is within the fluid circulation path between a first of the three of the fluid ejection chambers and a second of the three of the fluid ejection chambers and between the second of the three of the fluid ejection chambers and a third of the three of the fluid ejection chambers.

13. The fluid ejection device of claim 11, wherein the fluid circulation path includes a first portion communicated with the first of the three of the fluid ejection chambers to direct fluid in a first direction, a second portion communicated with a second of the three of the fluid ejection chambers to direct fluid in a second direction opposite the first direction, a third portion communicated with a third of the three of the fluid ejection chambers to direct fluid in the first direction, a first channel loop between the first portion and the second portion, and a second channel loop between the second portion and the third portion, wherein the portion of the fluid circulation path having the fluid circulating element therewithin comprises one of the first portion, the second portion, and the third portion.

14. The fluid ejection device of claim 11, wherein the three of the fluid ejection chambers are to substantially simultaneously eject drops of fluid therefrom, wherein the drops of fluid are to coalesce during flight.

15. The fluid ejection device of claim 11, wherein a fluid flow distance between the fluid circulating element and a first of the three of the fluid ejection chambers is less than a fluid flow distance between the fluid circulating element and each of a second of the three of the fluid ejection chambers and a third of the three of the fluid ejection chambers.

16. A method of operating a fluid ejection device, comprising:

communicating three laterally adjacent fluid ejection chambers with a fluid slot, each of the three laterally adjacent fluid ejection chambers including a drop ejecting element;

circulating fluid from the fluid slot through the three laterally adjacent fluid ejection chambers with a fluid circulation path including a fluid circulating element within a portion of the fluid circulation path extended between at least two laterally adjacent fluid ejection chambers of the three laterally adjacent fluid ejection chambers; and substantially simultaneously ejecting drops of fluid from at least two laterally adjacent fluid ejection chambers of the three laterally adjacent fluid ejection chambers, wherein the drops of fluid are to coalesce during flight.

17. The method of claim 16, further comprising:

substantially simultaneously ejecting drops of fluid from the three laterally adjacent fluid ejection chambers, wherein the drops of fluid are to coalesce during flight.

18. The method of claim 16, wherein a fluid flow distance between the fluid circulating element and a first of the three laterally adjacent fluid ejection chambers is less than a fluid flow distance between the fluid circulating element and each of a second of the three laterally adjacent fluid ejection chambers and a third of the three laterally adjacent fluid ejection chambers.

* * * * *